US010451218B2

(12) United States Patent
Strange et al.

(10) Patent No.: US 10,451,218 B2
(45) Date of Patent: Oct. 22, 2019

(54) BRACKETED SUPPORT FOR A DOUBLE WALLED CRYOGENIC STORAGE VESSEL

(71) Applicant: Westport Power Inc., Vancouver (CA)

(72) Inventors: Martin A. Strange, Vancouver (CA); Brian Girard, Surrey (CA)

(73) Assignee: WESTPORT POWER INC., Vancouver (CA)

( * ) Notice: Subject to any disclaimer, the term of this patent is extended or adjusted under 35 U.S.C. 154(b) by 33 days.

(21) Appl. No.: 15/313,945

(22) PCT Filed: May 13, 2015

(86) PCT No.: PCT/CA2015/050433
§ 371 (c)(1),
(2) Date: Nov. 23, 2016

(87) PCT Pub. No.: WO2015/176177
PCT Pub. Date: Nov. 26, 2015

(65) Prior Publication Data

US 2017/0130900 A1 May 11, 2017

(30) Foreign Application Priority Data

May 23, 2014 (CA) ..... 2852451

(51) Int. Cl.
*F17C 13/00* (2006.01)
*F17C 13/08* (2006.01)
*F17C 3/08* (2006.01)

(52) U.S. Cl.
CPC ..... *F17C 3/08* (2013.01); *F17C 13/08* (2013.01); *F17C 2201/0109* (2013.01);
(Continued)

(58) Field of Classification Search
CPC ..... F17C 3/08; F17C 2201/0109; F17C 2201/056; F17C 2203/0629;
(Continued)

(56) References Cited

U.S. PATENT DOCUMENTS 2,823,822 A * 2/1958 Altman ..... F17C 13/086 114/74 A
2,874,865 A * 2/1959 Canty ..... F17C 13/086 220/586

(Continued)

FOREIGN PATENT DOCUMENTS

CA 2441775 A1 11/2003
DE 202012007223 U1 10/2012
DE 202013101162 U1 5/2013

OTHER PUBLICATIONS

International Search Report and Written Opinion dated Jul. 22, 2015, in connection with the corresponding International Patent Application No. PCT/CA2015/050433 having International Publication No. WO2015176177.

(Continued)

*Primary Examiner* — Gideon R Weinerth
(74) *Attorney, Agent, or Firm* — Carie C. Mager

(57) ABSTRACT

Unconstrained rotational movement of an inner vessel with respect to an outer vessel at one end of a cryogenic storage vessel increases stress in supports at an opposite end. A storage vessel for holding a cryogenic fluid comprises an inner vessel defining a cryogen space and having a longitudinal axis, and an outer vessel spaced apart from and surrounding the inner vessel, defining a thermally insulating space between the inner and outer vessels. A structure for supporting the inner vessel within the outer vessel at one end comprises an inner vessel support bracket connected with the inner vessel, an outer vessel support bracket connected with the outer vessel, and an elongated support extending (Continued)

between and mutually engaging the inner and outer support brackets to constrain radial and rotational movement of the inner vessel with respect to the outer vessel and to allow axial movement of the inner vessel with respect to the outer vessel along the longitudinal axis.

11 Claims, 7 Drawing Sheets

(52) U.S. Cl.
CPC .. *F17C 2201/056* (2013.01); *F17C 2203/014* (2013.01); *F17C 2203/0391* (2013.01); *F17C 2203/0629* (2013.01); *F17C 2223/0161* (2013.01); *F17C 2223/033* (2013.01); *F17C 2260/011* (2013.01); *F17C 2270/0168* (2013.01)

(58) Field of Classification Search
CPC ..... F17C 2223/0161; F17C 2223/033; F17C 2260/011; F17C 2270/0168; F17C 13/08; F17C 13/086; F17C 2203/014; F17C 2203/01; F17C 2223/0153; F16C 3/03; F16C 3/04; F16C 3/06; F16D 3/06; F16D 2001/103; F16D 1/06; Y10T 403/7035; Y10T 403/7026; Y10T 403/7033; Y10T 403/7077
USPC ..... 220/560.1, 901, 560.06, 560.05, 560.11, 220/918, 562; 464/162, 179; 403/359.6, 403/359.1; 62/45.1, 51.1, 53.2
See application file for complete search history.

(56) References Cited

U.S. PATENT DOCUMENTS 3,154,212 A * 10/1964 Brush ..... F17C 13/086 220/560.1
3,163,313 A * 12/1964 Reynolds ..... F17C 13/083 220/560.11
3,208,622 A * 9/1965 Trentham ..... B64D 37/06 220/560.09
3,217,920 A * 11/1965 Holben ..... F17C 13/086 220/560.1
3,339,782 A * 9/1967 Segura ..... F17C 13/082 114/74 A
3,425,585 A * 2/1969 Latham ..... F17C 13/083 220/560.06
3,446,388 A * 5/1969 Greenberg ..... F17C 13/086 220/560.04
3,460,706 A * 8/1969 Hoover ..... B65D 81/3811 220/592.2
3,692,206 A * 9/1972 Hornbeck ..... F17C 3/02 206/445
3,764,036 A * 10/1973 Dale ..... F17C 9/00 220/560.05
3,805,552 A * 4/1974 Heald ..... F16C 29/02 376/285
3,905,508 A * 9/1975 Hibl ..... B60K 15/07 220/476
4,038,832 A * 8/1977 Lutgen ..... F17C 13/086 114/74 A
4,115,022 A * 9/1978 Orain ..... F16D 3/06 192/108
4,357,137 A * 11/1982 Brown ..... F16D 1/06 464/150
4,487,332 A * 12/1984 Huang ..... F17C 3/085 220/560.05
4,765,507 A * 8/1988 Yavorsky ..... B29C 70/86 137/590
5,012,948 A * 5/1991 Van Den Bergh .... F17C 13/087 220/560.05
5,243,874 A * 9/1993 Wolfe ..... B29C 45/14754 280/775
5,293,127 A * 3/1994 Palkovich ..... F17C 13/087 324/318
5,503,494 A * 4/1996 Kamata ..... F16D 1/0858 403/359.6
5,507,203 A * 4/1996 Audibert ..... B62D 1/185 464/162
5,533,340 A * 7/1996 Shama ..... F17C 3/08 220/901
5,595,376 A * 1/1997 Hua ..... B23B 31/4046 269/48.1
7,344,045 B2 * 3/2008 Harper ..... F17C 1/00 220/560.09
7,775,391 B2 8/2010 Harper
2005/0139600 A1 * 6/2005 Harper ..... F17C 1/00 220/560.13
2014/0166662 A1 * 6/2014 Snyder ..... F17C 13/00 220/560.1
2015/0211681 A1 * 7/2015 Conaughty ..... F17C 1/12 220/560.12
2015/0275946 A1 * 10/2015 Ishizaki ..... B62D 1/20 403/359.1
2016/0047455 A1 * 2/2016 Wittig ..... B21D 39/04 74/421 R
2016/0305610 A1 * 10/2016 Karng ..... F17C 3/08
2017/0058940 A1 * 3/2017 Wehner ..... F16C 3/03
2017/0130900 A1 * 5/2017 Strange ..... F17C 3/08
2019/0145580 A1 * 5/2019 Posselt ..... F17C 1/12 220/560.12

OTHER PUBLICATIONS

Extended European Search Report dated Dec. 8, 2017, in connection with the corresponding European Patent Application No. 15796133.5 having International Publication No. EP3146253A1.

* cited by examiner

BRACKETED SUPPORT FOR A DOUBLE WALLED CRYOGENIC STORAGE VESSEL

FIELD OF THE INVENTION

The present application relates to a cryogenic storage vessel support, and more particularly to a support in a double-walled cryogenic storage vessel for constraining movement between an inner vessel and an outer vessel at one end of the cryogenic storage vessel.

BACKGROUND OF THE INVENTION

With reference to FIG. 1, double-walled cryogenic storage vessels comprise an inner vessel and an outer vessel spaced apart from and surrounding the inner vessel, where the space between the vessels is a thermally insulating space, such as a vacuum space, that reduces heat leak into a cryogen space inside the inner vessel. The inner and outer vessels can have a horizontal configuration where the longitudinal axis (10) extends along the horizontal plane. In vehicular applications the inner and outer vessels are exposed to various loads, such as axial loads, radial loads, and torsional loads as the vessels experience forces acting upon them during acceleration of the vehicle. Axial loads acting on the inner vessel are defined herein to be the loads acting in a direction parallel to the longitudinal axis, which defines the "axial direction". The radial axis (20) intersects the longitudinal axis at right angles. Radial loads acting on the inner vessel are defined herein to be the loads acting in a direction transverse to the longitudinal axis and parallel with the radial axis, which defines the "radial direction". Torsional loads acting on the inner vessel are defined herein to be the loads acting in a direction transverse to the longitudinal axis and the radial axis, such as in the direction of axis (30) in FIG. 2, and which result in the inner vessel rotating about the longitudinal axis with respect to the outer vessel.

In the Applicant's co-owned U.S. Pat. Nos. 7,344,045 and 7,775,391, axial, radial and rotational movement of the inner vessel with respect to the outer vessel is constrained, at one end of the cryogenic storage vessel, by piping that extends from the cryogen space to outside the cryogenic storage vessel, and which is attached to support brackets secured to the inner and outer vessels. At the opposite end of the cryogenic storage vessel the inner vessel is constrained in the radial direction with respect to the outer vessel, and is free to move in the axial and rotational directions. The inner vessel is constrained to move in the axial direction at one end of the cryogenic storage vessel only to allow for axial expansion and contraction of the vessels while the cryogenic storage vessel is thermally cycled between ambient temperature and cryogenic temperatures. In one technique of constraining radial but not axial or rotational movement, a non-metallic support extends between two support brackets connected with the inner and outer vessels respectively at one end of the cryogenic storage vessel. In another technique, two straps extend in opposite directions from a collar around a bearing surface of a non-metallic support (secured to the inner vessel) and which are secured to the inner surface of the outer vessel. The collar and bearing surface allows for axial movement of the inner vessel with respect to the outer vessel, while the straps constrain the radial movement of the inner vessel.

One problem with cryogenic storage vessels that constrain only the radial movement of the inner vessel with respect to the outer vessel, at one end, is the stress put on vessel supports at the opposite end due to the unconstrained rotational movement at the one end creating a torsional load between the vessels that can fatigue supports. The state of the art is lacking in techniques for constraining radial and rotational movement between the inner and outer vessels of a double-walled cryogenic storage vessel at one end, while allowing for axial movement at that one end. The present apparatus provides a technique for improving cryogenic storage vessel supports.

SUMMARY OF THE INVENTION

An improved storage vessel for holding a cryogenic fluid comprises an inner vessel defining a cryogen space and having a longitudinal axis and an outer vessel spaced apart from and surrounding the inner vessel, defining a thermally insulating space between the inner vessel and the outer vessel. A structure for supporting the inner vessel within the outer vessel at one end of the storage vessel comprises an inner vessel support bracket connected with the inner vessel, an outer vessel support bracket connected with the outer vessel, and an elongated support. The elongated support extends between and mutually engages the inner and outer support brackets to constrain radial and rotational movement of the inner vessel with respect to the outer vessel and to allow axial movement of the inner vessel with respect to the outer vessel along the longitudinal axis.

At least one of the inner vessel support bracket, the outer vessel support bracket and the elongated support is made from a material having lower thermal conductivity than the inner and outer vessels. In a preferred embodiment, the elongated support is made from a non-metallic material. The inner and outer vessel support brackets can be cup-shaped. In another preferred embodiment, the inner vessel support bracket can be integrated with the elongated support, or alternatively, the outer vessel support bracket can be integrated with the elongated support.

In a preferred embodiment, the inner vessel support bracket comprises a first bore having a first inner profile, the outer support bracket comprises a second bore having a second inner profile, and the elongated support comprises an outer profile. The outer profile of the elongated support mutually engages the first and second profiles, of the first and second bores in inner and outer support brackets respectively, in an inter-locking manner. In preferred embodiments the first and second inner profiles and the outer profile are one of a spline, a square and a rectangle.

An improved storage vessel for holding a cryogenic fluid comprises an inner vessel defining a cryogen space and having a longitudinal axis and an outer vessel spaced apart from and surrounding the inner vessel, defining a thermally insulating space between the inner vessel and the outer vessel. A structure for supporting the inner vessel within the outer vessel at one end comprises an outer vessel support connected with the outer vessel, and an inner vessel support connected with the inner vessel. The inner vessel support mutually engages the outer vessel support to constrain radial and rotational movement of the inner vessel with respect to the outer vessel and to allow axial movement of the inner vessel with respect to the outer vessel along the longitudinal axis.

In a preferred embodiment, the outer vessel support comprises a first support bracket and the inner vessel support comprises a second support bracket and an elongated support extending between and mutually engaging the first and second support brackets.

In another preferred embodiment, the inner vessel support comprises a first support bracket and the outer vessel support comprises a second support bracket and an elongated support extending between and mutually engaging the first and second support brackets.

DETAILED DESCRIPTION OF PREFERRED EMBODIMENT(S)

Figure 1:
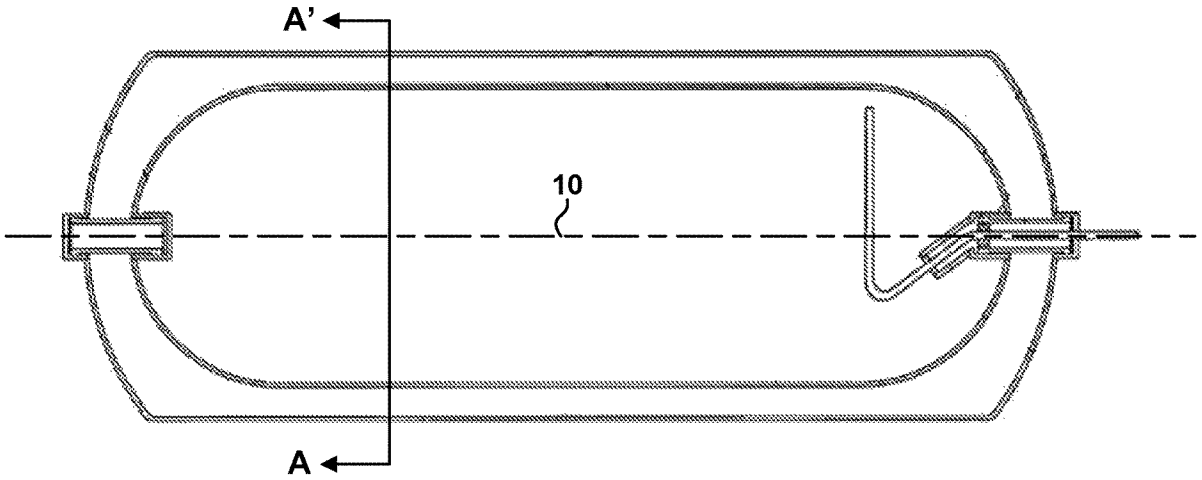
FIG. 1 Prior Art
FIG. 1 is a side elevational view of a prior art cryogenic storage vessel.
Figure 2:
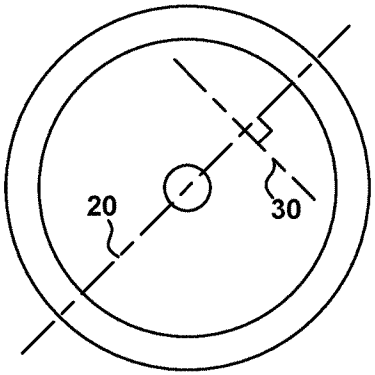
FIG. 2 Prior Art
FIG. 2 is a cross-sectional view of the cryogenic storage vessel of FIG. 1 taken along line A-A'.
Figure 3:
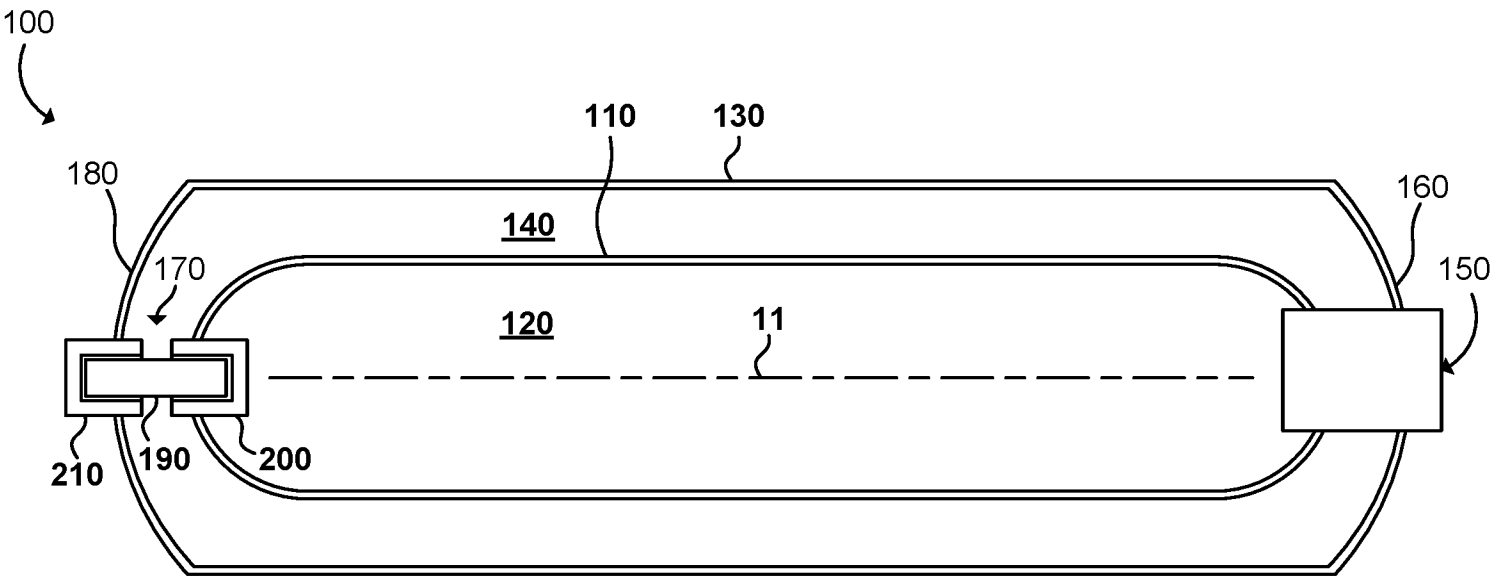
FIG. 3 is a cross-sectional view of a cryogenic storage vessel comprising a support structure according to a first embodiment.
Figure 4:
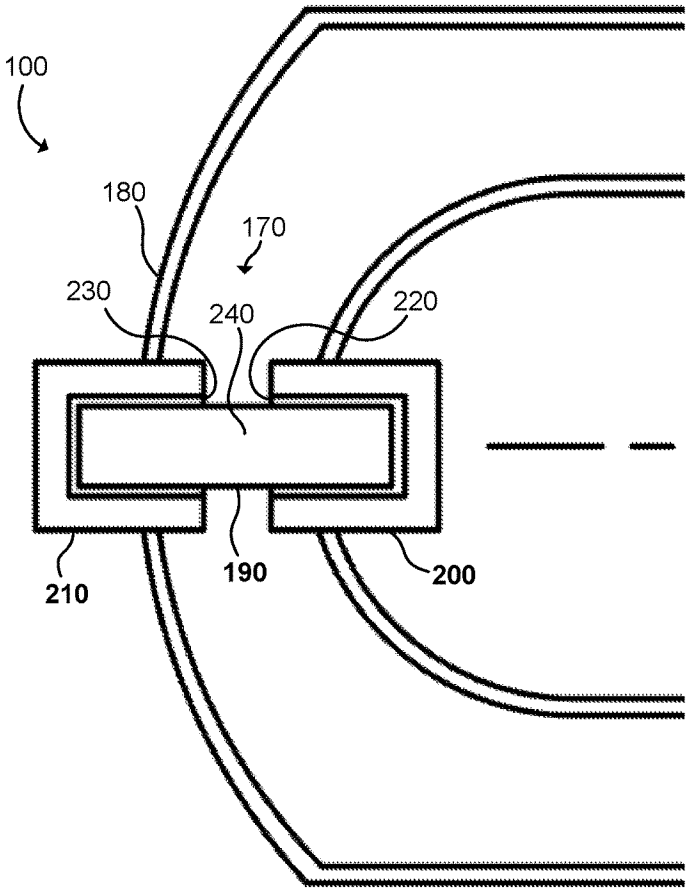
FIG. 4 is a partial cross-sectional view of the support structure of FIG. 3.
Figure 6:
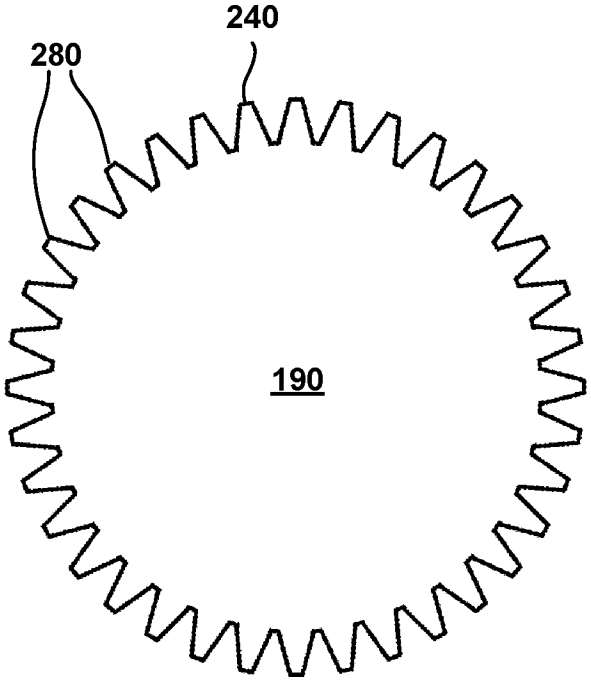
FIG. 6 is an end elevational view of a support having an outer surface with a spline profile that extends between the inner and outer vessels along the longitudinal axis and mutually engages the spline profile of the support brackets of FIG. 5.
Figure 5:
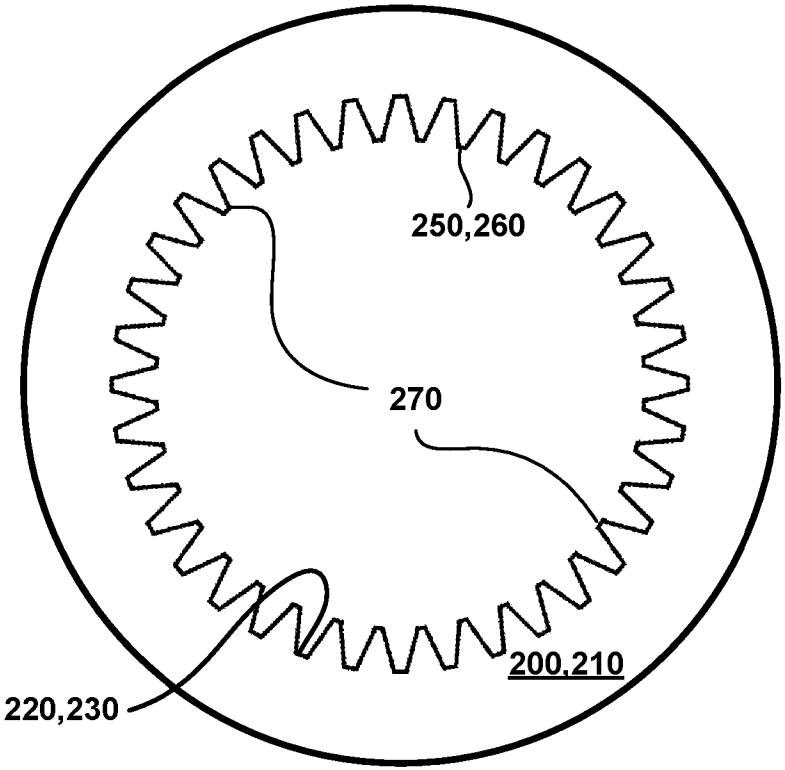
FIG. 5 is an end elevational view of a support bracket for the cryogenic storage vessel of FIG. 3 having a spline profile according to a first embodiment. One such support bracket is connected with the inner vessel and another one is connected with the outer vessel.

Referring to FIG. 3, there is shown cryogenic storage vessel 100 comprising inner vessel 110, defining cryogen space 120, and outer vessel 130 spaced apart from and surrounding the inner vessel, defining thermally insulating space 140 (a vacuum space). Support structure 150 at end 160 of cryogenic storage vessel 100 constrains axial, radial and rotational movement of inner vessel 110 with respect to outer vessel 130, as would be known by those skilled in the technology. Support structure 170 at end 180 constrains radial and rotational movement of inner vessel 110 with respect to outer vessel 130, and allows for axial movement of the inner vessel along longitudinal axis 11 with respect to the outer vessel. Elongated support 190 extends between and mutually engages inner vessel support bracket 200 and outer vessel support bracket 210 such that radial and rotational movement is constrained. To reduce heat leak into cryogen space 120, at least one of support 190 and support brackets 200, 210 are made from a material having lower thermal conductivity, and preferably substantially lower thermal conductivity, than inner and outer vessels 110 and 130. In a preferred embodiment support 190 is a non-metallic material having lower thermal conductivity than support brackets 220 and 210 and the inner and outer vessels. Inner and outer support brackets 200 and 210 are securely connected with respective vessels 110 and 130. Support 190 can be made hollow in order to reduce the overall weight of cryogenic storage vessel 100. In another preferred embodiment support brackets 200 and 210 are identical cup-shaped support brackets that are welded to their respective vessels 110 and 130. However, this is not a requirement and in other embodiments support brackets 200 and 210 may each comprise unique structural features for securing to their respective vessels. With reference to FIG. 4, support 190 extends into bore 220 of support bracket 200, and into bore 230 of support bracket 210. Bores 220 and 230 each have inner profiles that are mutually engageable with outer profile 240 of the outer surface of support 190, in an inter-locking manner, such that radial and rotational movement is constrained. Referring to FIGS. 5 and 6, inner profiles 250 and 260 of bores 220 and 230 in support brackets 200 and 210 respectively and outer profile 240 of support 190 have spline profiles. Teeth 270 on inner profiles 250 and 260 inter-lock with teeth 280 on outer profile 240. The number and shape of inter-locking teeth can vary according to application requirements. Other embodiments of profiles are discussed below. In still further embodiments other profiles not disclosed herein can be employed that allow support 190 to mutually engage with support brackets 200 and 210 such that radial and rotational movement of inner vessel 110 is constrained with respect to outer vessel 130 at end 180.

Figure 8:
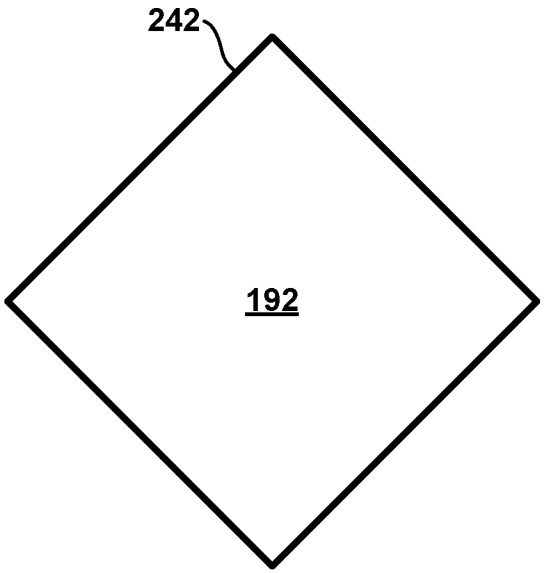
FIG. 8 is an end elevational view of a support having an outer surface with a square profile that extends between the inner and outer vessels along the longitudinal axis and mutually engages the square profile of the support brackets of FIG. 7.
Figure 7:
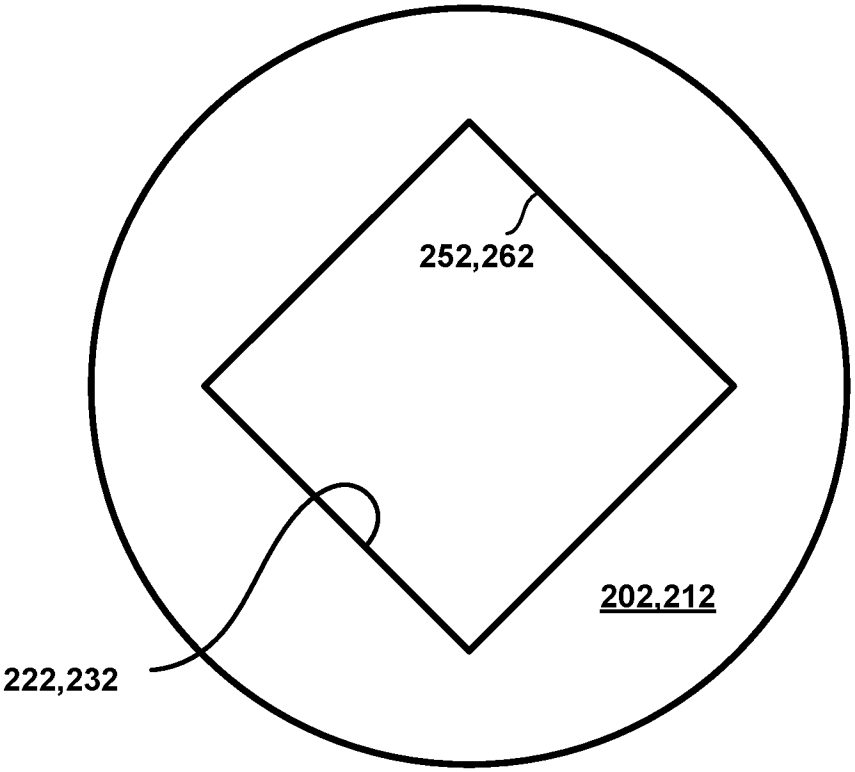
FIG. 7 is an end elevational view of a support bracket for the cryogenic storage vessel of FIG. 3 having a square profile according to a second embodiment. One such support bracket is connected with the inner vessel and another one is connected with the outer vessel.

Referring to FIGS. 7 and 8 a second embodiment of mutually engaging inner and outer profiles is illustrated. Inner profiles 252 and 262 of bores 222 and 232 in support brackets 202 and 212 respectively and outer profile 242 of support 192 have a square profile. When support 192 mutually engages support brackets 202 and 212, that is support 192 extends into bores 222 and 232, radial and rotational movement of inner vessel 110 is constrained with respect to outer vessel 130 at end 180.

Figure 10:
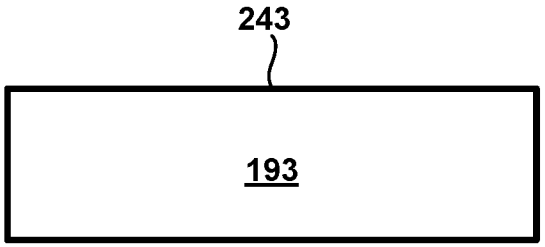
FIG. 10 is an end elevational view of a support having an outer surface with a rectangular profile that extends between the inner and outer vessels along the longitudinal axis and mutually engages the rectangular profile of the support brackets of FIG. 9.
Figure 9:
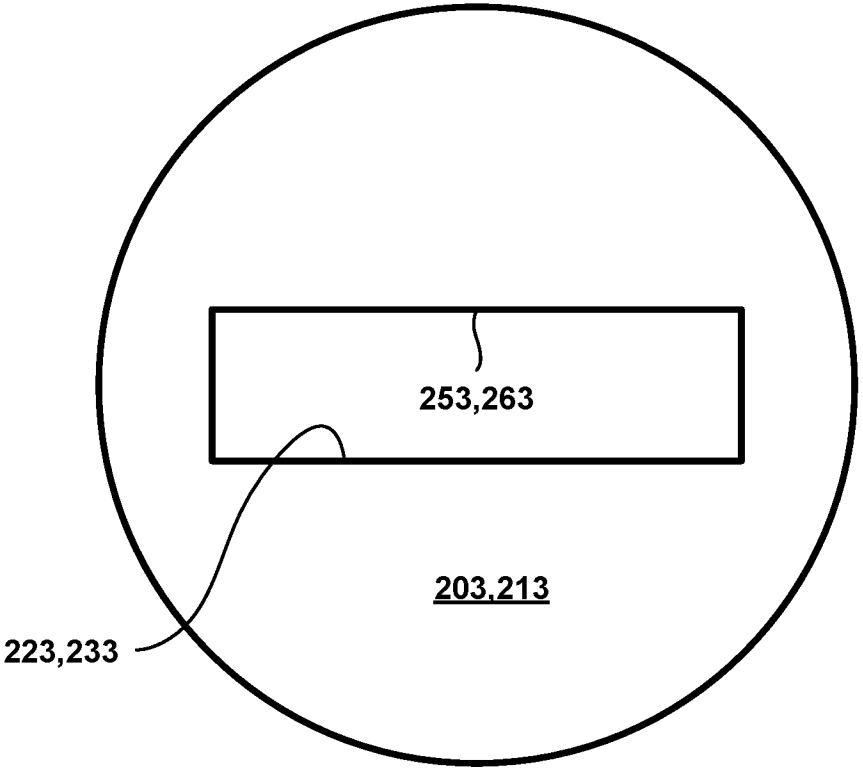
FIG. 9 is an end elevational view of a support bracket for the cryogenic storage vessel of FIG. 3 having a rectangular profile according to a third embodiment. One such support bracket is connected with the inner vessel and another one is connected with the outer vessel.

Referring to FIGS. 9 and 10, a third embodiment of mutually engaging inner and outer profiles is illustrated. Inner profiles 253 and 263 of bores 223 and 233 in support brackets 203 and 213 respectively and outer profile 243 of support 193 have a rectangular profile. When support 193 mutually engages support brackets 203 and 213, that is support 193 extends into bores 223 and 233, radial and rotational movement of inner vessel 110 is constrained with respect to outer vessel 130 at end 180.

Figure 11:
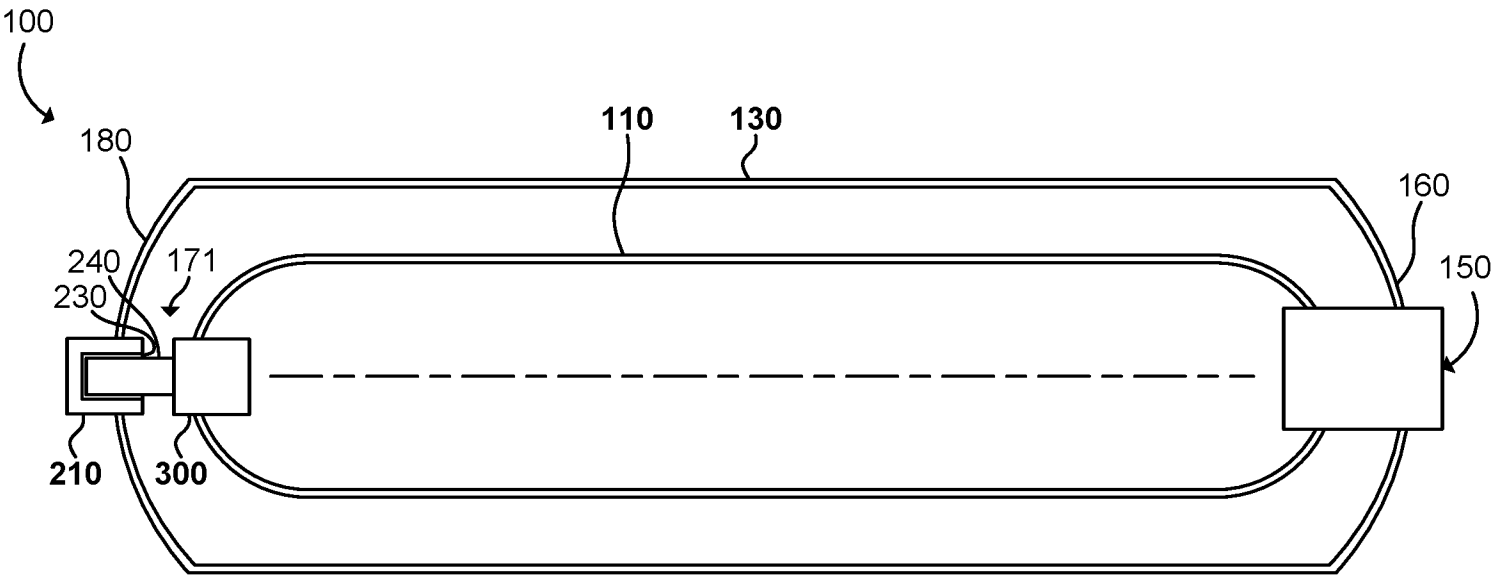
FIG. 11 is cross-sectional view of a cryogenic storage vessel comprising a support structure according to a second embodiment.

Referring now to FIG. 11, support structure 171 is illustrated according to second embodiment that is similar to support structure 170 of the first embodiment and where like parts have like reference numerals and will not be discussed in detail if at all. Support 300 is the integration into a unitary component of support 190 and support bracket 200 of FIG. 4, and in other embodiments support bracket 210 can be integrated with support 190. Outer profile 240 of the outer surface of support 300 mutually engages with the inner profile of bore 230 such that radial and rotational movement of inner vessel 110 is constrained with respect to outer vessel 130, at end 180, while the inner vessel is free to move in the axial direction.

While particular elements, embodiments and applications of the present invention have been shown and described, it will be understood, that the invention is not limited thereto since modifications can be made by those skilled in the art without departing from the scope of the present disclosure, particularly in light of the foregoing teachings.

What is claimed is:

1. A storage vessel for holding a cryogenic fluid comprising:

an inner vessel defining a cryogen space and having a longitudinal axis;

an outer vessel spaced apart from and surrounding the inner vessel, defining a thermally insulating space between the inner vessel and the outer vessel; and a structure for supporting the inner vessel within the outer vessel at one end of the storage vessel comprising:

an inner vessel support bracket connected with the inner vessel, said inner vessel support bracket having a first bore with a first inner profile of a multiplicity of outwardly tapering teeth;

an outer vessel support bracket connected with the outer vessel, said outer vessel support bracket having a second bore with a second inner profile of a multiplicity of outwardly tapering teeth; and an elongated support having an outer profile of a multiplicity of outwardly tapering teeth, said elongated support extending between and mutually engaging the first and second profiles of the inner and outer vessel support brackets respectively in an inter-locking manner to constrain radial and rotational movement of the inner vessel with respect to the outer vessel and to allow axial movement of the inner vessel with respect to the outer vessel along the longitudinal axis.

2. The storage vessel of claim 1, wherein at least one of the inner vessel support bracket, the outer vessel support bracket and the elongated support is made from a material having lower thermal conductivity than the inner and outer vessels.

3. The storage vessel of claim 1, wherein the elongated support is made from a non-metallic material.

4. The storage vessel of claim 1, wherein the inner vessel support bracket and the outer vessel support bracket are cup-shaped.

5. The storage vessel of claim 1, wherein the inner vessel support bracket is integrated with the elongated support.

6. The storage vessel of claim 1, wherein the outer vessel support bracket is integrated with the elongated support.

7. The storage vessel of claim 1, wherein each of said multiplicity of teeth are substantially evenly distributed along a circumference of each profile respectively.

8. A storage vessel for holding a cryogenic fluid comprising:

an inner vessel defining a cryogen space and having a longitudinal axis;

an outer vessel spaced apart from and surrounding the inner vessel, defining a thermally insulating space between the inner vessel and the outer vessel; and a structure for supporting the inner vessel within the outer vessel at one end comprising:

an outer vessel support connected with the outer vessel, said outer vessel support having a profile of a multiplicity of outwardly tapering teeth; and an inner vessel support connected with the inner vessel, said inner vessel support having a profile of a multiplicity of outwardly tapering teeth that mutually engages the outer vessel support to constrain radial and rotational movement of the inner vessel with respect to the outer vessel and to allow axial movement of the inner vessel with respect to the outer vessel along the longitudinal axis.

9. The storage vessel of claim 8, wherein the outer vessel support comprises a first support bracket and the inner vessel support comprises a second support bracket and an elongated support extending between and mutually engaging the first and second support brackets.

10. The storage vessel of claim 8, wherein the inner vessel support comprises a first support bracket and the outer vessel support comprises a second support bracket and an elongated support extending between and mutually engaging the first and second support brackets.

11. The storage vessel of claim 8, wherein said multiplicity of teeth are substantially evenly distributed along a circumference of each profile respectively.

* * * * *